US007033144B2

(12) United States Patent
Yoshimura et al.

(10) Patent No.: US 7,033,144 B2
(45) Date of Patent: Apr. 25, 2006

(54) COOLING FAN FOR A SCREW COMPRESSOR DRIVE MOTOR

(75) Inventors: Shoji Yoshimura, Takasago (JP); Hajime Nakamura, Kako-gun (JP)

(73) Assignee: Kabushiki Kaisha Kobe Seiko Sho, Kobe (JP)

( * ) Notice: Subject to any disclaimer, the term of this patent is extended or adjusted under 35 U.S.C. 154(b) by 349 days.

(21) Appl. No.: 10/452,286

(22) Filed: Jun. 3, 2003

(65) Prior Publication Data

US 2003/0228229 A1 Dec. 11, 2003

(30) Foreign Application Priority Data

Jun. 5, 2002 (JP) ..... 2002-164674

(51) Int. Cl.
*F04B 39/04* (2006.01)
*H02K 9/00* (2006.01)

(52) U.S. Cl. ..... 417/228; 310/53; 310/58

(58) Field of Classification Search ..... 417/228; 310/52, 53, 58, 59, 64
See application file for complete search history.

(56) References Cited

U.S. PATENT DOCUMENTS 2,469,820 A * 5/1949 Fuge ..... 310/58
6,599,097 B1 * 7/2003 Kim ..... 417/205
6,798,079 B1 * 9/2004 Nelson et al. ..... 290/2

FOREIGN PATENT DOCUMENTS

JP 63-213436 9/1988
JP 404000291 A * 1/1992

OTHER PUBLICATIONS

Patent Abstracts of Japan, JP 63-213436, Sep. 6, 1988.
Patent Abstracts of Japan, JP 6-086595, Mar. 25, 1994.
Patent Abstracts of Japan, JP 5-300697, Nov. 12, 1993.

* cited by examiner

*Primary Examiner*—Charles G. Freay
(74) *Attorney, Agent, or Firm*—Oblon, Spivak, McClelland, Maier & Neustadt, P.C.

(57) ABSTRACT

A oil-cooled type screw compressor of the present invention includes a compressor main unit storing a pair of male and female screw rotors driven by a motor and meshing with each other, a cooling fan provided independently to the motor for blowing air toward the motor, and control means for receiving a detected temperature signal from a temperature detector for detecting the coil temperature of the motor, and conducting control for increasing/decreasing the fan rotation speed of the cooling fan according to the coil temperature so as to maintain the coil temperature within a permissible range. It is possible to use the coil current of the motor or the motor rotation speed and the discharge pressure in place of the detected temperature signal. This constitution provides a screw compressor which offers fan-removed heat quantity not excessive or insufficient with respect to the motor heat generation quantity, and realizes sufficient cooling for the motor, and energy saving.

3 Claims, 4 Drawing Sheets

COOLING FAN FOR A SCREW COMPRESSOR DRIVE MOTOR

BACKGROUND OF THE INVENTION

1. Field of the Invention

The present invention relates to a screw compressor using a motor as a drive source air-cooled by a cooling fan.

2. Description of the Related Art

Conventionally, a screw compressor driven by a motor including a cooling fan for air-cooling mounted coaxially is publicly known. When the output torque of the motor is T (kg·m), the motor rotation speed is n (rpm), and the compressor power (motor output) is P (W), their relationship is represented by the following expression.

$$T=0.974P/n$$

When the discharge pressure is constant, for example, since the output torque T is constant, the compressor power is proportional to the motor rotation speed.

On the other hand, in this motor, a loss is generated at a certain ratio to the motor output, and the loss changes into the motor heat generation quantity. Then, when this motor heat generation quantity abnormally increases the coil temperature of the motor, since the coil presents the insulation failure, it is necessary to prevent the insulation failure, and thus, the motor is air-cooled by the cooling fan. When the coil temperature is maintained constant, since the motor heat generation quantity to be removed by the air-cooling is proportional to the compressor power, the motor heat generation quantity increases/decreases proportional to the motor rotation speed if the motor rotation speed changes.

The cooling airflow quantity from the cooling fan is proportional to the square of the rotation speed.

In case of the screw compressor described above, the cooling fan is disposed coaxially with the motor, its rotation speed is always equivalent to the motor rotation speed, and the relationship between the motor heat generation quantity and the heat quantity removed by the cooling fan, namely the fan-removed heat quantity, is shown in FIG. 7 (horizontal axis: motor rotation speed, vertical axis: heat quantity). The motor rotation speed changes within a certain range, the "MIN" on the horizontal axis indicates its minimum value, and the "MAX" indicates its maximum value. Also, as described above, the motor heat generation quantity shown with a solid line changes in proportion to the motor rotation speed. And, if the cooling fan is designed such that the motor heat generation quantity and the fan-removed heat quantity are equal when the motor rotation speed is at the maximum (SAX), the fan-removed heat quantity changes as a long dashed short dashed line indicates with respect to the motor rotation speed, and the fan-removed heat quantity falls short by a quantity represented by I when the motor rotation speed is at the minimum (MIN).

In contrast, if the cooling fan is designed such that the motor heat generation quantity and the fan-removed heat quantity is equal when the motor rotation speed is at the minimum (MIN), the fan-removed heat quantity becomes excessive by a quantity represented by II as a long dashed double short dashed line indicates when the motor rotation speed is at the maximum (MAX), the fan power is used wastefully, and a problem of acting against energy saving occurs.

As other prior art, Japanese Patent Application Publication S63-213436 discloses art where a cooling fan is provided independently to a motor driving a compressor main unit for blowing air to the motor, and the airflow quantity is controlled according to the motor rotation speed, thereby maintaining the motor temperature constant. The motor rotation speed is detected by detecting the frequency of an inverter.

However, the motor temperature does not depend only on the rotation speed of the motor for driving the compressor main unit. The motor temperature changes under the influence from other different factors. Thus, with the constitution of Japanese Patent Application Publication S63-213436, since the rotation speed of the cooling fan is determined based on the rotation speed of the motor however the actual temperature of the motor might be, it is difficult to efficiently cool the motor.

SUMMARY OF THE INVENTION

The present invention is devised to eliminate the foregoing conventional problem, and provides a screw compressor which offers fan-removed heat quantity not excessive or insufficient with respect to the motor heat generation quantity, and realizes sufficient cooling for the motor, and energy saving.

To solve the above problem, a first aspect of the present invention provides a screw compressor including a motor, a pair of male and female screw rotors driven by the motor, and meshing with each other, a compressor main unit for storing the screw rotors, a discharge flow passage extending from the compressor main unit, a cooling fan provided independently to the motor, and capable of blowing air toward the motor, a temperature detector for detecting the coil temperature of the motor, and control means for controlling the fan rotation speed of the cooling fan so as to maintain the coil temperature of the motor within a permissible range. The control means receives a detected temperature signal from the temperature detector, and controls the fan rotation speed based on the detected temperature signal.

A second aspect of the present invention provides a screw compressor including a motor, a pair of male and female screw rotors driven by the motor, and meshing with each other, a compressor main unit for storing the screw rotors, a discharge flow passage extending from the compressor main unit, a cooling fan provided independently to the motor, and capable of blowing air toward the motor, a current detector for detecting the coil current of the motor, and control means for controlling the fan rotation speed of the cooling fan so as to maintain the coil temperature of the motor within a permissible range. The control means receives a detected current signal from the current detector, and controls the fan rotation speed based on the detected current signal.

A third aspect of the present invention provides a screw compressor including a motor, a pair of male and female screw rotors driven by the motor, and meshing with each other, a compressor main unit for storing the screw rotors, a discharge flow passage extending from the compressor main unit, a cooling fan provided independently to the motor, and capable of blowing air toward the motor, a rotation speed detector for detecting the motor rotation speed of the motor, a pressure detector for detecting the discharge pressure in the discharge flow passage, and control means for controlling the fan rotation speed of the cooling fan so as to maintain the coil temperature of the motor within a permissible range. The control means receives a detected rotation speed signal from the rotation speed detector and a detected pressure signal from the pressure detector, and controls the fan rotation speed based on the detected rotation speed signal and the detected pressure signal.

With the present invention constituted as described above, since the fan rotation speed is controlled such that fan-removed heat quantity is not excessive or insufficient with respect to the motor heat generation quantity, the present invention offers such effects as sufficient cooling for the motor and energy saving.

DESCRIPTION OF THE PREFERRED EMBODIMENTS

The following section describes embodiments of the present invention following drawings.

Figure 1:
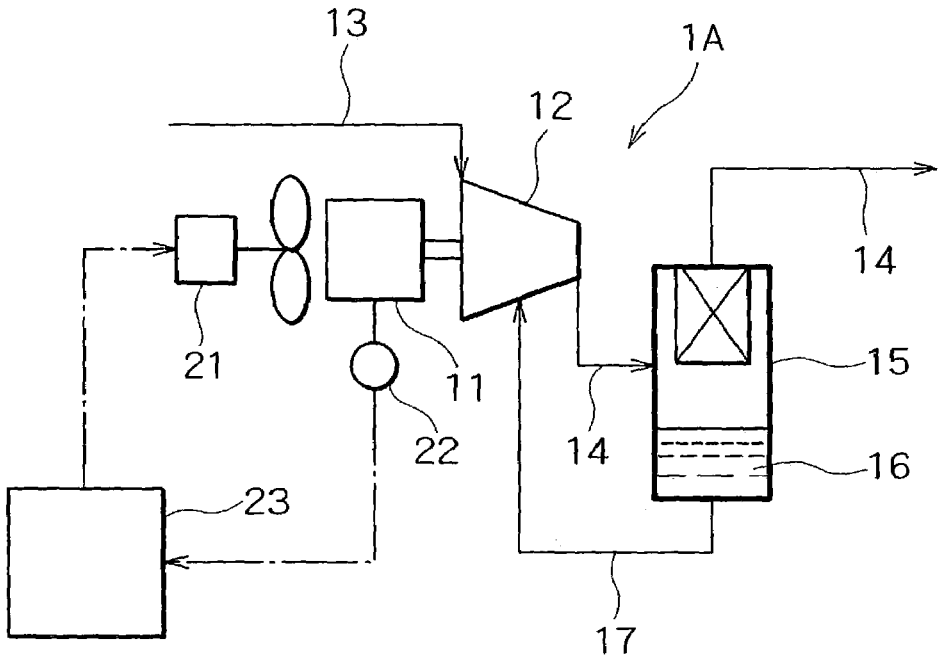
FIG. 1 shows an overall constitution of an oil-cooled type screw compressor according to a first embodiment of the present invention.

FIG. 1 shows an oil-cooled type screw compressor 1A according to the first embodiment, and the oil-cooled type screw compressor 1A includes a compressor main unit 12 containing an unillustrated pair of male and female screw rotors driven by a motor 11, and meshing with each other. A suction flow passage 13 is connected with one side of the compressor main unit 12, and a discharge flow passage 14 is connected with the other side of it. An oil separator/collector 15 is interposed on the discharge flow passage 14, and an oil flow passage 17 extends from an oil sump 16 below the oil separator/collector 15 to locations to be supplied with oil such as a rotor room, and bearings/shaft seals inside the compressor main unit 12.

Figure 2:
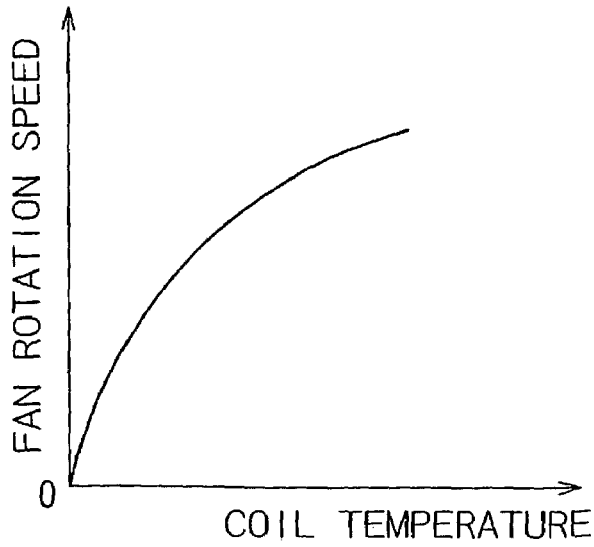
FIG. 2 shows the relationship between coil temperature and fan rotation speed in the oil-cooled type screw compressor shown in FIG. 1.

The oil-cooled type screw compressor 1A further includes a cooling fan 21 which is provided independently to the motor 11 so as to blow air toward the motor 11, and control means 23 which receives a detected temperature signal from a temperature detector 22 for detecting the coil temperature of the motor 11, and controls the fan rotation speed of the cooling fan 21 according to the coil temperature. Specifically, as shown in FIG. 2 (horizontal axis: coil temperature, vertical axis: fan rotation speed), based on the relationship between the fan rotation speed and the coil temperature obtained in advance, the control means 23 conducts such control that the fan rotation speed is increased as the coil temperature increases, and the fan rotation speed is decreased as the coil temperature decreases.

As the temperature detector 22 for detecting the coil temperature of the motor 11, a resistance bulb, a thermocouple, and a thermistor may be used. The temperature detector is installed such that it is inserted into an end of the coil of the stator in the coil.

As for controlling the fan, the present invention is not limited to the example described above. For example, it is possible that predetermined upper limit and lower limit temperatures are determined in advance, after starting the compressor, the rotation of the fan at a fixed rotation speed starts when the coil temperature indicated by the detected temperature signal from the rotation detector 22 exceeds the upper limit temperature, and from this point until the compressor stops, the fan stops when the coil temperature decreases down to the lower limit temperature, and the fan starts again at the fixed rotation speed when the coil temperature increases up to the upper limit temperature. A temperature which can sufficiently avoid an occurrence of insulation failure of the motor, such as 150° C., may be set as the upper limit temperature, and a temperature which is lower than the upper limit temperature, such as 120° C., may be set as the lower limit temperature.

With this constitution, the motor coil temperature is directly detected, and is used as detected data. Therefore, compared with detecting other parameter, since it is not necessary to convert from the parameter to a value corresponding to the motor coil temperature, and simultaneously, it is possible to neglect interference affecting the correlation between the parameter and the motor coil temperature, more precise control is realized. Namely, even if the compressor presents a high rotation speed, its power is low, and the heat generation from the motor is also low when the discharge pressure is low. Therefore, the heat generation quantity of the motor, and furthermore the coil temperature, cannot be uniquely determined only from the motor rotation speed. In addition, the coil temperature increases or decreases due to the temperature of the cooling air blown by the cooling fan, and the fluctuation of the power supply voltage. Namely, the heat generation quantity of the motor and the coil temperature can be determined most precisely by detecting the coil temperature itself.

Figure 3:
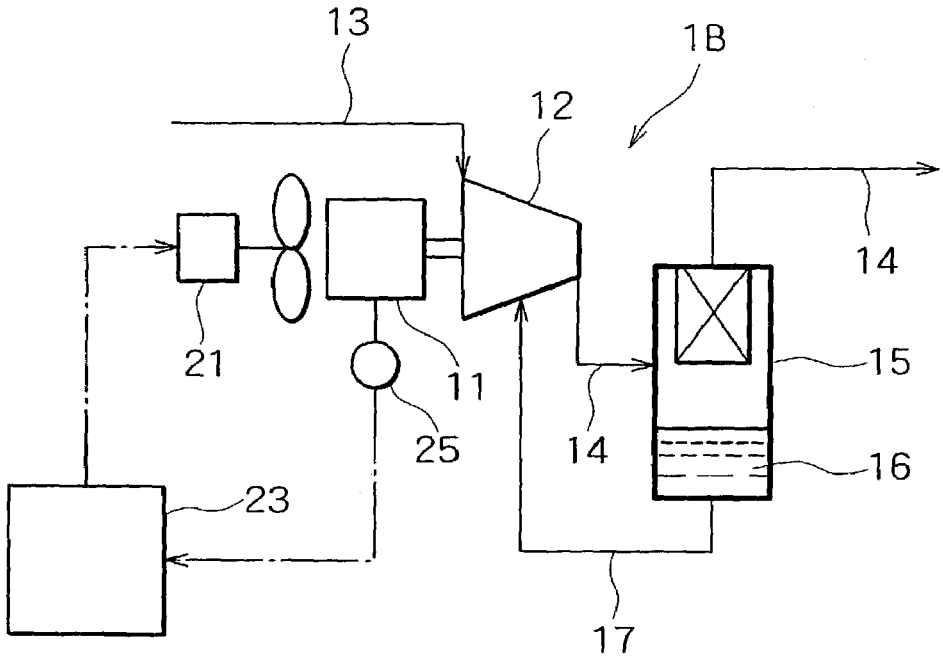
FIG. 3 shows an overall constitution of an oil-cooled type screw compressor according to a second embodiment of the present invention.

FIG. 3 shows an oil-cooled type screw compressor 1B according to a second embodiment of the present invention, parts common with the oil-cooled type screw compressor 1A are assigned with the same number, and description is not provided for them.

Figure 4:
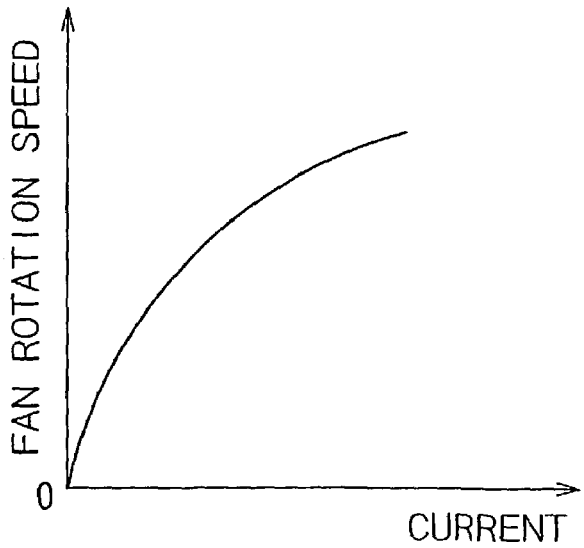
FIG. 4 shows the relationship between coil current and fan rotation speed in the oil-cooled type screw compressor shown in FIG. 3.

The oil-cooled type screw compressor 1B includes a current detector 25 for detecting the current on the coil of the motor 11 in place of the temperature detector 22, and the current detector 25 supplies the control means 23 with a detected current signal. Since the coil temperature and the current is proportional to each other, as FIG. 4 (horizontal axis: current, vertical axis: fan rotation speed) shows, based on the relationship between the fan rotation speed and the current obtained in advance, the control means 23 conducts such control that the fan rotation speed is increased as the current increases, and the fan rotation speed is decreased as the current decreases, and the coil temperature is maintained within a permissible range.

A publicly known ammeter may be disposed as the current detector 25 at a proper location in a motor drive electric circuit.

The heat generation quantity of the motor is proportional to $I^2$, the square of the motor current I, and the coil temperature is closely related with the heat generation quantity of the motor. Thus, it is possible to reflect the coil temperature more precisely by detecting the motor current than by detecting the motor rotation speed, though not as precisely as by detecting the coil temperature itself. Thus, the cooling control for motor is realized by detecting the motor current, and conducting the cooling control based on it as precisely as by detecting the coil temperature itself.

Figure 5:
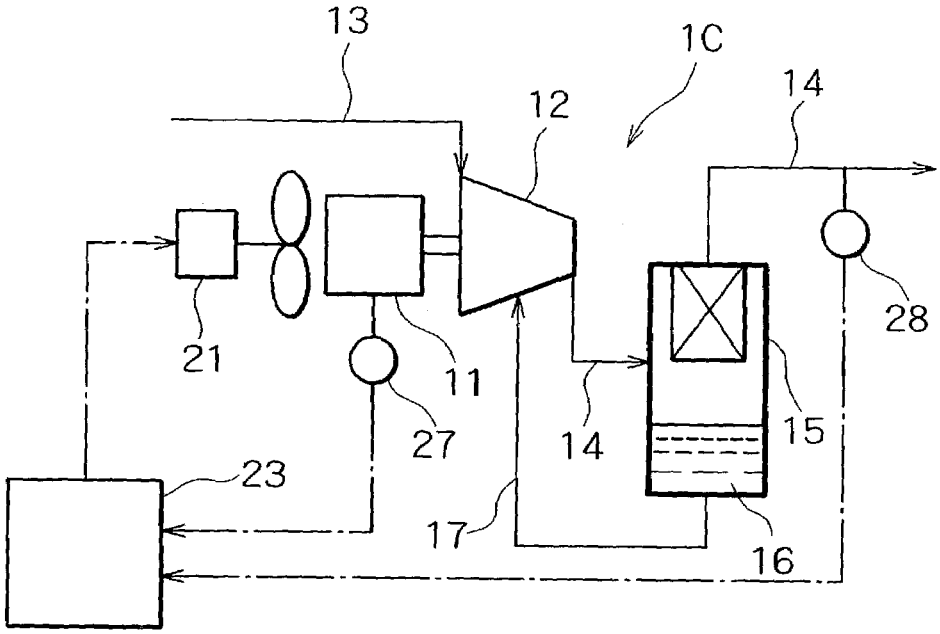
FIG. 5 shows an overall constitution of an oil-cooled type screw compressor according to a third embodiment of the present invention.

FIG. 5 shows an oil-cooled type screw compressor 1C according to a third embodiment of the present invention, parts common with the oil-cooled type screw compressor 1A are assigned with the same number, and description is not provided for them.

Figure 6:
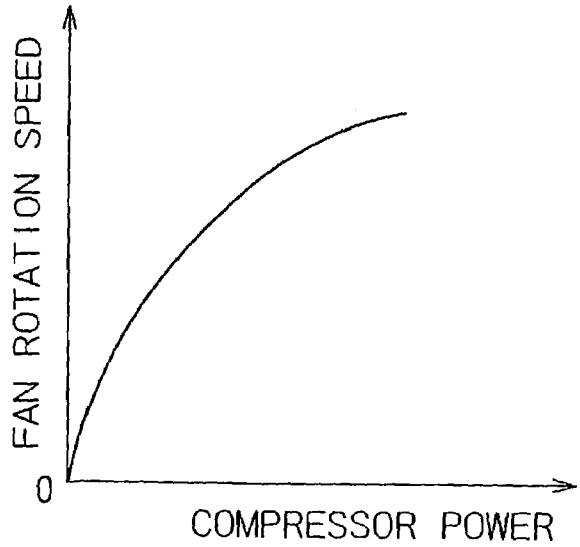
FIG. 6 shows the relationship between compressor power and fan rotation speed in the oil cooled type screw compressor shown in FIG. 5.
Figure 7:
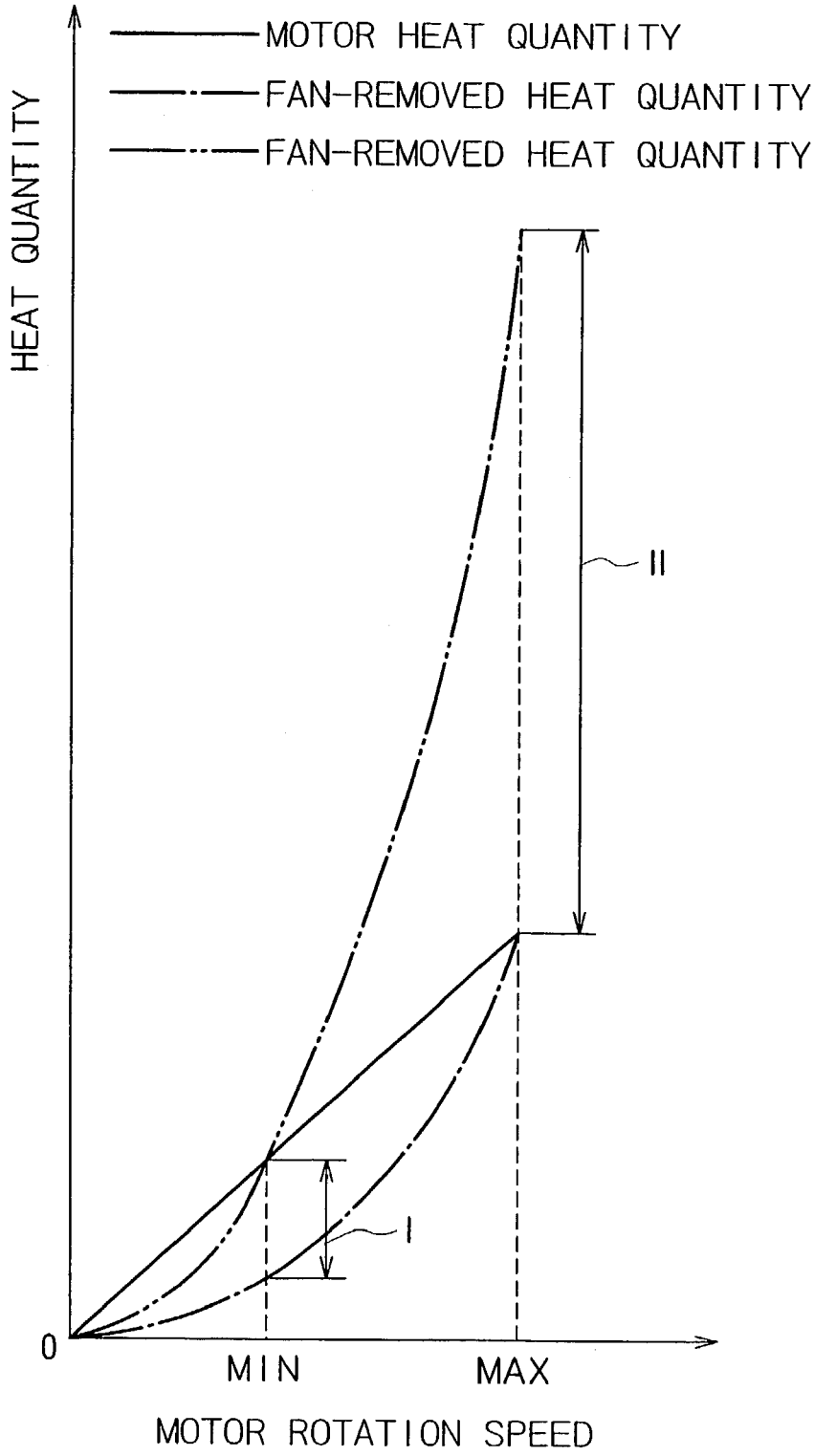
FIG. 7 shows the relationship between motor rotation speed and motor heat generation quantity, and the motor rotation speed and fan-removed heat quantity in a conventional screw compressor.

The oil-cooled type screw compressor 1C includes a rotation speed detector 27 for detecting the motor rotation speed of the motor 11 and a pressure detector 28 for detecting the discharge pressure in the discharge flow passage 14, in place of the temperature detector 22. The control means 23 receives a detected rotation speed signal from the rotation speed detector 27, and a detected pressure signal from the pressure detector 28, and calculates the compressor power based on these input signals. Since the compressor power is proportional to the coil temperature and the current, as FIG. 6 (horizontal axis: compressor power, vertical axis: fan rotation speed) shows, based on the relationship between the compressor power and the fan rotation speed obtained in advance, the control means 23 conducts such control that the fan rotation speed is increased as the compressor power increases, and the fan rotation speed is decreased as the compressor power decreases, and the coil temperature is maintained with in a permissible range.

The compressor power P is generally represented by the following expression.

$$P \propto \alpha \times P1 \times Q \times \{(P2/P1)^{\beta} - 1\}$$

where α, β: coefficients, Q: suction equivalent airflow quantity ($m^3$/min), P1: suction pressure, and P2: discharge pressure.

In this equation, since the suction equivalent airflow quantity Q is proportional to the motor rotation speed R, and P1 is the atmospheric pressure, when the motor rotation speed R and the discharge pressure P2 are detected, the compressor power can be calculated. Note that, as described above, the heat generation quantity of the motor is proportional to the $I^2$ of the square of the motor current, and a relationship, the motor output ∝ the compressor power, exists. Since the heat generation quantity of the motor is closely related with the compressor power, and the compressor power can be obtained by detecting the motor rotation speed R and the discharge pressure P2, it may be viewed that the heat generation quantity of the motor can be obtained from the motor rotation speed R and the discharge pressure P2. Thus, when the heat generation quantity is estimated from the motor rotation speed R and the discharge pressure P2, and the cooling airflow quantity, and furthermore the rotation speed of the fan, corresponding to the heat generation quantity are obtained, proper cooling is enabled. In this way, the cooling control for motor is realized as precisely as by detecting the coil temperature itself by detecting the motor rotation speed R, and the discharge pressure P2, and then conducting the cooling control based on them.

Publicly known detectors may be properly used as the rotation speed detector 27 and the pressure detector 28.

The control method applied for controlling the fan rotation speed of the cooling fan such that the coil temperature of the motor is maintained within the permissible range is not specifically limited either in the second or third embodiment. As described in the first embodiment, different control methods can be applicable.

An apparatus used as the control means 23 in the first through third embodiments is not specifically limited. An apparatus having a publicly known constitution such as a control apparatus using a microprocessor may be properly used.

While the oil-cooled type screw compressors 1A, 1B, and 1C are described in the section above, the present invention is not limited to the oil-cooled type screw compressor, and includes an oil-free type screw compressor, and the oil separator/collector 15 and the oil flow passage 17 are not provided in the oil-free type screw compressor.

What is claimed is:

1. A screw compressor comprising:

a motor;

a pair of male and female screw rotors driven by said motor, and meshing with each other;

a compressor main unit for storing said screw rotors;

a discharge flow passage extending from said compressor main unit;

a cooling fan provided independently to said motor, and capable of blowing air toward said motor;

a temperature detector for detecting the coil temperature of said motor; and control means for controlling the fan rotation speed of said cooling fan such that the coil temperature of said motor is maintained within a permissible range, wherein said control means receives a detected temperature signal from said temperature detector, and then controls the fan rotation speed based on the detected temperature signal.

2. A screw compressor comprising:

a motor;

a pair of male and female screw rotors driven by said motor, and meshing with each other;

a compressor main unit for storing said screw rotors;

a discharge flow passage extending from said compressor main unit;

a cooling fan provided independently to said motor, and capable of blowing air toward said motor;

a current detector for detecting the current of a coil of said motor;

control means for controlling the fan rotation speed of said cooling fan such that the coil temperature of said motor is maintained within a permissible range, wherein said control means receives a detected current signal from said current detector, and controls the fan rotation speed based on the detected current signal.

3. A screw compressor comprising:

a motor;

a pair of male and female screw rotors driven by said motor, and meshing with each other;

a compressor main unit for storing said screw rotors;

a discharge flow passage extending from said compressor main unit;

a cooling fan provided independently to said motor, and capable of blowing air toward said motor;

a rotation speed detector for detecting the motor rotation speed of said motor;

a pressure detector for detecting the discharge pressure in said discharge flow passage;

control means for controlling the fan rotation speed of said cooling fan such that the coil temperature of said motor is maintained within a permissible range, wherein said control means receives a detected rotation speed signal from said rotation speed detector and a detected pressure signal from said pressure detector, and controls the fan rotation speed based on the detected rotation speed signal and the detected pressure signal.

* * * * *

UNITED STATES PATENT AND TRADEMARK OFFICE

CERTIFICATE OF CORRECTION

PATENT NO. : 7,033,144 B2
APPLICATION NO. : 10/452286
DATED : April 25, 2006
INVENTOR(S) : Yoshimura et al.

It is certified that error appears in the above-identified patent and that said Letters Patent is hereby corrected as shown below:

On the title page, Item (73), the Assignee Information is incorrect. Item (73) should read:

-- (73) Assignee: Kabushiki Kaisha Kobe Seiko Sho (Kobe Steel, Ltd.) Kobe (JP)--

Signed and Sealed this

Twenty-fifth Day of July, 2006

JON W. DUDAS
*Director of the United States Patent and Trademark Office*